US005301746A

United States Patent [19]

Trage et al.

[11] Patent Number: 5,301,746

[45] Date of Patent: Apr. 12, 1994

[54] NATURAL DRAFT COOLING TOWER

[75] Inventors: Burkhard Trage, Ratingen; Richard Leitz, Hilden; Georg Schrey, Ratingen, all of Fed. Rep. of Germany

[73] Assignee: Balcke-Dürr Aktiengesellschaft, Ratingen, Fed. Rep. of Germany

[21] Appl. No.: 7,532

[22] Filed: Jan. 22, 1993

[30] Foreign Application Priority Data

Jan. 25, 1992 [DE] Fed. Rep. of Germany ..... 4202069

[51] Int. Cl.[5] ..... F28B 9/08

[52] U.S. Cl. ..... 165/113; 165/900

[58] Field of Search ..... 165/113, 900

[56] References Cited

U.S. PATENT DOCUMENTS

| | | | |
|---|---|---|---|
| 3,498,590 | 3/1970 | Furlong | 165/900 |
| 3,519,068 | 7/1970 | Harris et al. | 165/900 |
| 3,844,344 | 10/1974 | Kliemann et al. | 165/900 |
| 3,888,305 | 6/1975 | Gerz | 165/113 |
| 3,942,588 | 3/1976 | Schoonman | 165/900 |
| 3,944,636 | 3/1976 | Schuldenberg et al. | 165/900 |
| 4,129,180 | 12/1978 | Larinoff | 165/113 |
| 4,243,095 | 1/1981 | Kosten | 165/900 |
| 4,446,914 | 5/1984 | Russell | 165/900 |
| 4,690,207 | 9/1987 | Trage et al. | 165/113 |

FOREIGN PATENT DOCUMENTS

| | | | |
|---|---|---|---|
| 59577 | 1/1968 | Fed. Rep. of Germany | 165/900 |
| 1960619 | 12/1969 | Fed. Rep. of Germany . | |
| 2242058 | 8/1972 | Fed. Rep. of Germany . | |
| 2405999 | 2/1974 | Fed. Rep. of Germany . | |
| 2728749 | 8/1978 | Fed. Rep. of Germany | 165/900 |
| 3441514 | 11/1984 | Fed. Rep. of Germany . | |
| 594618 | 9/1925 | France | 165/900 |
| 1183193 | 3/1970 | United Kingdom | 165/900 |
| 1349683 | 4/1974 | United Kingdom | 165/900 |

*Primary Examiner*—John Rivell
*Assistant Examiner*—L.R. Leo
*Attorney, Agent, or Firm*—Robert W. Becker & Associates

[57] ABSTRACT

A natural draft cooling tower for condensing turbine steam of a power plant is comprised of identical sectors assembled to form the cooling tower. A central steam inlet line terminates in radial distributing lines. Each sector has one of the radial distributing lines. Each sector has first heat exchanger elements operating in a condensational manner and second heat exchanger elements operating in a dephlegmational manner, with the second heat exchanger elements arranged downstream of the first heat exchanger elements. The second heat exchanger elements are each provided with a fan. Each sector has an inert gas line connected to the second heat exchanger elements and a condensate removal line connected to the first and the second heat exchangers. Each sector further comprises an independent support frame for supporting the first and the second heat exchanger elements. The first heat exchanger elements are connected to the support frame such that their longitudinal axis is perpendicular to the radial distributing line and extends in a plane parallel to the radial plane of the radial distributing lines.

8 Claims, 3 Drawing Sheets

NATURAL DRAFT COOLING TOWER

BACKGROUND OF THE INVENTION

The present invention relates to a natural draft cooling tower with a plurality of heat exchanger elements, preferably in the shape of a pitched roof, for condensing turbine exhaust steam of a power plant, wherein the heat exchanger elements, supplied with the exhaust steam by a common central steam inlet line and radially extending distributing lines, operate in part in a condensational and in part in a dephlegmational manner, with the dephlegmationally operating heat exchanger elements arranged downstream of the condensationally operating heat exchanger elements, the heat exchanger elements distributed over a plurality of identical sectors, each sector having complete lines for steam distribution as well as inert gas and condensate removal lines.

Such natural draft cooling towers for condensation of turbine exhaust steam of a power plant are known from German Offenlegungsschrift 34 41 514. Since the collection of inert gases within the heat exchanger elements must be prevented, the final condensation is performed in the dephlegmationally operating, forced-vented heat exchanger elements from which the inert gases are removed. In order to provide the dephlegmationally operating heat exchanger elements with a sufficient& amount of cooling air during all conceivable load situations and during unfavorable weather conditions, these dephlegmationally operating heat exchanger elements are provided with their own fans. These fans ensure a complete final condensation of the entire turbine exhaust steam to be condensed within the dephlegmationally operating heat exchanger elements even under unfavorable weather conditions such as strong lateral winds and inversion situations and provide also the option that, due to the resulting additional draft power within the cooling tower that is otherwise operated only by natural draft, the cooling tower shell can be designed with a respectively reduced height to thereby lower construction costs.

From German Auslegeschrift 19 60 619 a symmetrically designed natural draft cooling tower is known in which the heat exchanger elements which are essentially in the shape of a pitched roof are arranged radially with respect to the longitudinal axis of the cooling tower. The steam to be condensed is supplied via a centrally arranged steam inlet line from which radially extending steam distribution lines branch off to the ridge of the respective pitched roof-shaped heat exchanger elements. These operate in part in a condensational and in part in a dephlegmational manner whereby the dephlegmationally operating heat exchanger elements are arranged on an inner circle about the steam inlet line. One dephlegmationally operating heat exchange element is coordinated with two condensationally operating heat exchanger elements which are arranged in the radial extension of the dephlegmational heat exchanger element so that essentially an arrangement of heat exchanger elements within individual segments results. All of the heat exchange elements as well as their corresponding lines are arranged on a single common support construction which is supported on shoulders of the outer shell of the natural draft cooling tower.

From German Offenlegungsschrift 24 05 999 a natural draft cooling tower with a radial arrangement of the individual heat exchanger elements is known. The condensationally operating heat exchanger elements are arranged on an outer circle and the dephlegmationally operating heat exchanger elements are arranged on an inner circle close to the central steam inlet line. The arrangement of the condensationally operating heat exchange elements is two-stepped. A first condensational step is embodied by heat exchanger elements arranged adjacent to the outer wall of the cooling tower, and a second condensational step is provided by heat exchanger elements radially inwardly arranged and staggered relative to the heat exchanger elements of the first step. The second step is on a lower level than the first step. The heat exchanger elements of the second condensational step thus take over the remaining steam of two neighboring heat exchanger elements of the first condensational step. It is disadvantageous in this embodiment that due to the connection of the condensational heat exchanger elements with the respective neighboring radially displaced heat exchanger elements a reduced operation of the device with only a portion of the total number of heat exchanger elements present is not possible.

In a natural draft cooling tower known from German Offenlegungsschrift 22 42 058 condensationally operating heat exchanger elements are arranged on a plurality of circles about the central longitudinal axis of the cooling tower. The steam to be condensed is fed via steam inlet lines circularly arranged about the central longitudinal axis of the cooling tower. All heat exchanger elements of one circular arrangement are positioned on a common support construction in order to provide a staircase-like arrangement in the radially outwardly oriented direction by selecting respective suitable heights for the various circular arrangements.

Based on the disclosure of German Auslegeschrift 19 60 619 it is therefore an object of the present invention to provide a natural draft cooling tower which provides for a favorable adaptation of the respective condensation power to different operational conditions and/or to changing weather conditions and which, at the same time, provides for an optimal use of the base surface area of the cooling tower.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 2:
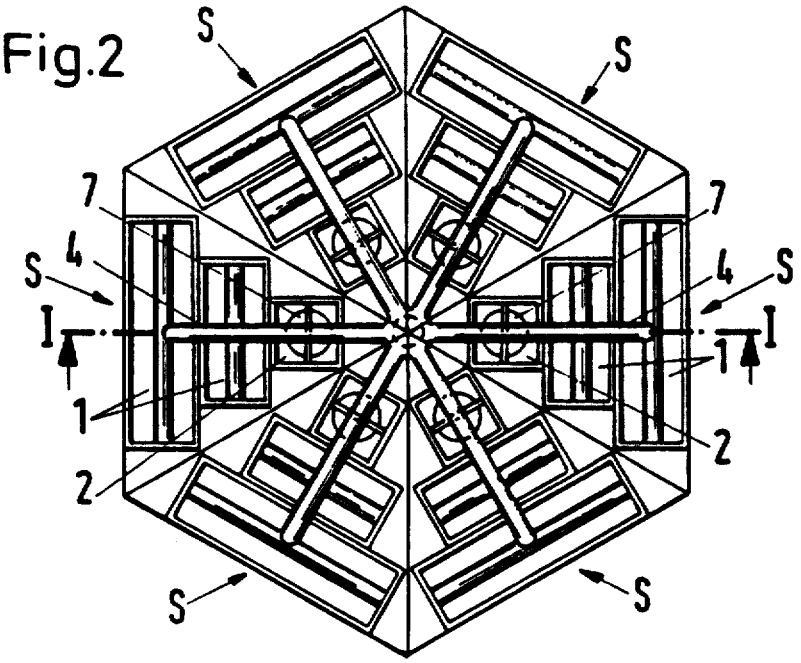
FIG. 2 is a plan view of the heat exchanger elements according to the section 11—11 in FIG. 1.

The natural draft cooling tower of the present invention is primarily characterized by:

Identical sectors assembled to form the cooling tower;

A central steam inlet line terminating in radial distributing lines extending in a radial plane, each sector having one of the radial distributing lines;

Each sector having first heat exchanger elements operating in a condensational manner and second heat exchanger elements operating in a dephlegmational manner, with the second heat exchanger elements arranged downstream of the first heat exchanger elements, the second heat exchanger elements each having a fan:

Each sector having an inert gas line connected to the second heat exchanger elements and a condensate removal line connected to the first and the second heat exchanger elements; and Each sector comprising an independent support frame for supporting the first and the second heat exchanger elements, with the first heat exchanger elements connected to the support frame such that a longitudinal axis of each first heat exchanger element is perpendicular to the radial distributing line and extends in a plane parallel to the radial plane of the radial distributing line.

Due to the inventive embodiment of a natural draft cooling tower it is achieved that the longitudinal dimensions of the heat exchanger elements which are preferably shaped in the form of a pitched roof can be selected to different length corresponding to their arrangement on the support frame which is identical for all sectors. Accordingly, an almost complete coverage of the sectors with heat exchanger elements is achieved so that the remaining free space is reduced to a minimum.

In a preferred embodiment of the present invention the first and the second heat exchanger elements have the shape of a pitched roof. Preferably, each first heat exchanger element has a radially outwardly extending portion and a radially inwardly extending portion with respect to the ridge of the pitched roof, with the radially outwardly extending portion having a greater longitudinal dimension than the radially inwardly extending portion. With this preferred embodiment the free space, respectively, the unused base surface area is further reduced.

With the inventive design of the natural draft cooling towers a considerable simplification of the construction and required calculations of natural draft cooling towers used for the condensation of turbine exhaust gas results because only one of the sectors of the cooling tower comprised of a plurality of sectors must be calculated and constructed. The identically designed and constructed sectors encompass respectively the corresponding number of condensationally and dephlegmationally operating heat exchanger elements corresponding to the respective share of heat exchanger elements per sector and include complete lines for the steam distribution and for the removal of inert gas and condensate, whereby the heat exchanger elements and the complete lines are arranged on respective separate support frames and a connection or attachment of the separate sectors is only provided by their connection into the centrally arranged steam inlet line. With the inventive natural draft cooling tower it is thus sufficient to calculate and construct only one of the sectors which represents essentially a building block for the cooling tower. This results at the same time in a reduction of the expenditure for the manufacture and assembly of the cooling tower because a plurality of identical sectors are manufactured and assembled so that manufacturing and assembly costs are reduced. Further advantages result for the operation of the inventive natural draft cooling tower because the independent sectors can be individually operated and switched on or off and can be adapted with respect to their cooling capacity so that especially an advantageous adaptation of the respective condensation capacity to different operational conditions and/or to changing weather conditions is possible.

In a further embodiment of the present invention the cooling tower shell is in the form of a steel construction whereby the cooling tower shell comprises a shell segment for each sector and wherein each support frame further supports the respective shell segment of the corresponding sector. With this inventive embodiment a foundation for the cooling tower shell is eliminated. This design further reduces the manufacturing costs for the inventive natural draft cooling tower because the support frames of the individual sectors simultaneously serve to support the steel construction of the cooling tower shell.

Preferably, the cooling tower shell has the shape of a closed polygon. This shape, which is the approximation of a circular base surface area, provides for a uniform loading of the heat exchanger elements with cooling air and prevents the formation of preferred or unfavorable wind directions. The heat exchanger elements in this embodiment are essentially arranged on a plurality of imaginary rings or circles with respect to the longitudinal axis of the cooling tower shell.

Preferably, the second heat exchangers are arranged such that a longitudinal axis of each second heat exchanger element is parallel to the longitudinal axis of the first heat exchanger elements.

In an alternative embodiment the second heat exchangers are connected to the support frame directly adjacent to the central steam inlet such that a longitudinal axis of each second heat exchanger element extends radially. Thus, the condensationally operating heat exchanger elements are arranged parallel to one another with their steam distributing chambers essentially positioned at the ridge of the pitched roof-shaped heat exchanger elements, extending in the same longitudinal direction and essentially forming a secant to the centrally arranged steam inlet line, whereby the dephlegmationally operating heat exchanger elements with their suction chambers positioned at the ridge of the pitched roof extending radially and located immediately adjacent to the steam inlet line on the support frame. This embodiment is advantageous with respect to guiding the remaining steam between the condensationally operating and the dephlegmationally operating heat exchanger elements.

In order to improve the resistance of the natural draft cooling tower with respect to lateral winds, the heat exchanger elements of each sector are arranged in a plane that is upwardly slanted from the central steam inlet line in the radially outward direction.

DESCRIPTION OF PREFERRED EMBODIMENTS

The present invention will now be described in detail with the aid of several specific embodiments utilizing FIGS. 1 through 5.

Figure 1:
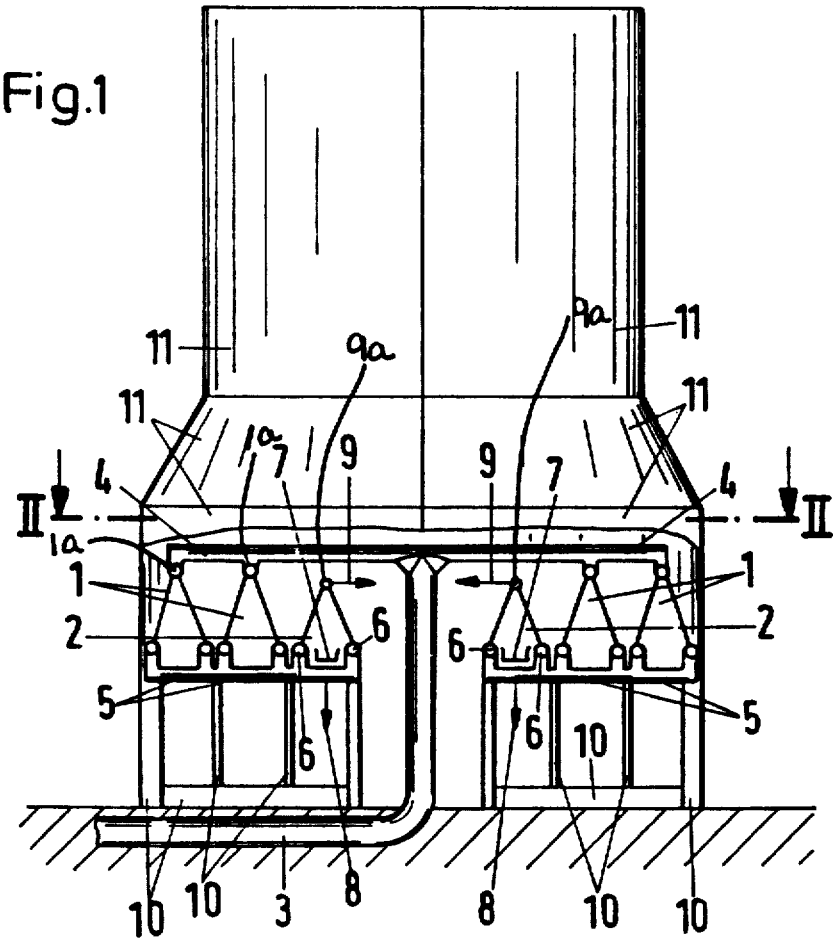
FIG. 1 is a side view of a first embodiment of the arrangement of the heat exchanger elements in a cross-section along the line I—I in FIG. 2.

A first embodiment represented in FIGS. 1 and 2 is a natural draft cooling tower encompassing a plurality of pitched roof-shaped heat exchanger elements 1, 2 connected to a steam inlet line 3 for condensing turbine exhaust steam of a non-represented power plant. The end portion of this steam inlet line 3 extends vertically in the center of the cooling tower and is connected to radially extending distributing lines 4, each coordinated with a respective sector S of the cooling tower, as can be seen especially in FIG. 2. In the embodiment of FIGS. 1 and 2, the cooling tower is made of six identical sectors S.

Via the central inlet line 3 and a respective radial distributing line 4 the steam to be condensed is guided into two condensationally operating heat exchanger elements 1 connected in parallel to one another. With these condensationally operated heat exchanger elements 1 the major portion of the steam is condensed. The remaining steam loaded with inert gases is guided via the collecting lines 5 into the distributing chambers 6 of the dephlegmationally operating heat exchanger element 2 arranged downstream of the condensationally operating heat exchange elements 1. The distributing chambers 6 are arranged at the bottom of the dephlegmational operating heat exchange element 2, as can best be seen best in FIG. 1. Within this dephlegmational operating heat exchanger element 2 the final condensation of the steam takes place. In order to ensure complete final condensation, each dephlegmational operating heat exchanger element 2 is provided with at least one fan 7. The condensate produced by the condensation at the heat exchanger elements 1 and 2 is collected below the dephlegmational operating heat exchanger element 2 by a condensate removal line 8. At the ridge of the dephlegmational operating heat exchanger element 2 the inert gases remaining after final condensation are removed by an inert gas line 9.

The heat exchanger elements 1 and 2 with their corresponding distributing line 4, collecting lines 5 as well as condensate removal line 8 and inert gas line 9 are connected to the separate support frame 10 of each individual sector S, as can be seen in FIG. 1. In the shown embodiment, this support frame 10 not only serves to support the heat exchanger elements 1 and 2 and the corresponding lines, but also simultaneously serves as a support or foundation for the cooling tower shell which, in the shown embodiment, is shaped like a closed polygon and is in the form of a steel construction made of individual shell segments 11. By employing individual support frames 10 for the individual sectors S as a foundation or support for the cooling tower shell comprised of shell segments 11 the conventional separate foundation for the cooling tower shell is eliminated.

As can be seen in the plan view of FIG. 2, the longitudinal dimension of the heat exchange elements 1 and 2 are adapted to the size of the base surface area in order to optimally use the space provided and are therefore different within each circular arrangement. The design of the individual ribbed tubes, their roof-shaped design, the bottom width of the heat exchanger elements 1, and the design of the chambers provided at the ridge or at the bottom portion are however identical.

The dephlegmationally operating heat exchange elements 2 are also comprised of identical, in the shown embodiment essentially square elements which are provided with one or a plurality of fans 7. As a function of the correspondingly needed surface area they can be arranged on the inner, the central, or the outer circular portion of each sector S. In the embodiment shown in FIGS. 1 and 2, an arrangement with a surface area ratio of approximately 5 to 1 of condensationally operating to dephlegmationally operating heat exchanger elements is represented, whereby the dephlegmationally operating heat exchanger elements are arranged on the inner circular portion of the sectors S. The suction chambers 9*a* for the inert gases provided at the ridge of the pitched roof-shaped dephlegmationally operating heat exchanger elements 2 are arranged in parallel to the steam distributing chambers 1*a* at the ridges of the pitched roof-shaped condensationally operating heat exchanger elements 1.

Figure 3:
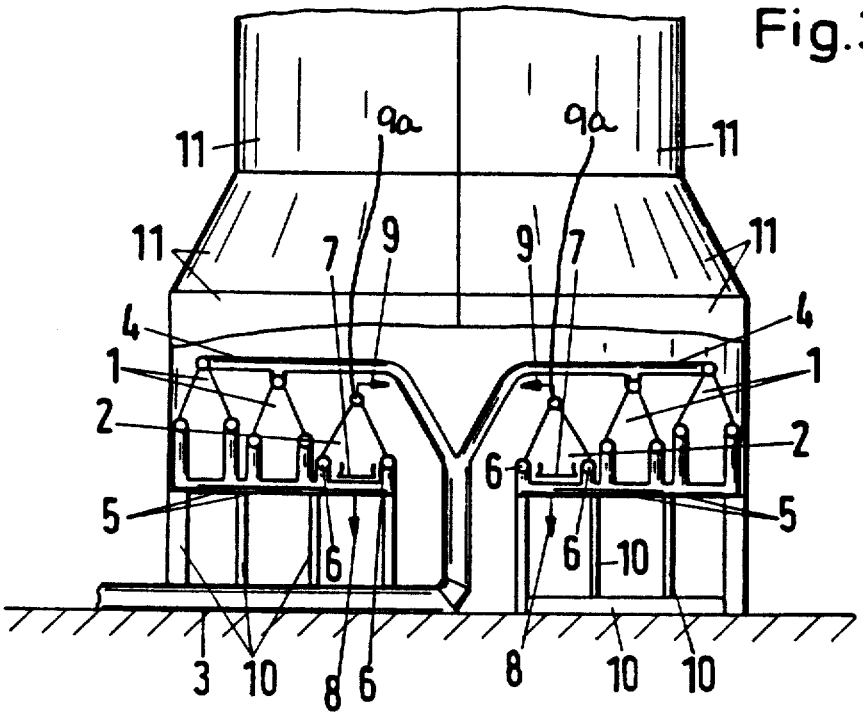
FIG. 3 is a representation corresponding to FIG. 1 of a second embodiment.

While in the embodiment according to FIG. 1 the heat exchanger elements 1 and 2 are arranged in a common horizontal plane, the second embodiment according to FIG. 3 shows an arrangement of the heat exchanger elements 1 and 2 within one sector S in a plane which ascends from the center outwardly. With this measure the resistance of the natural draft cooling tower against lateral winds is improved in a known manner.

Figure 4:
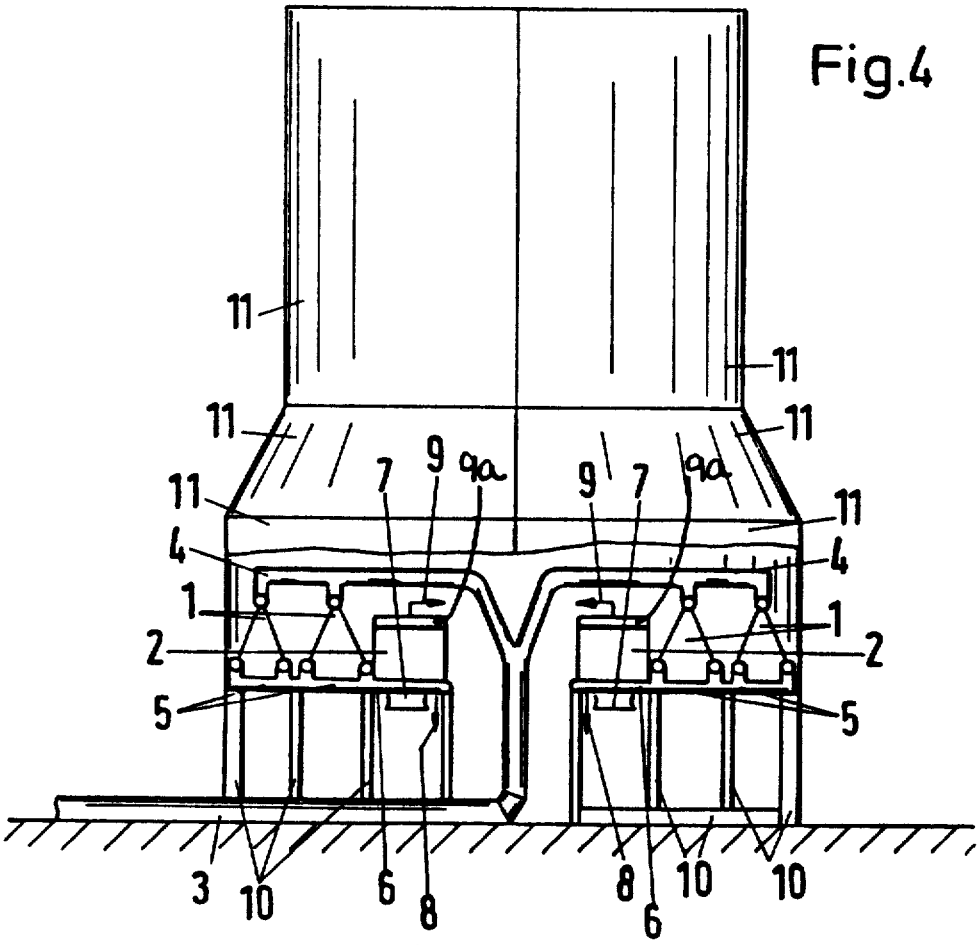
FIG. 4 is a further representation according to FIGS. 1 and 3 of a third embodiment.

In the third embodiment according to FIG. 4, a construction design is shown in which the suction chamber 9*a* at the ridge of the pitched roof-type dephlegmationally operating heat exchanger element 2 arranged in the innermost circular portion of the sector extends radially. With this design the collecting lines 5 coming from the condensationally operating heat exchanger elements 1 directly lead into the distributing chambers of the dephlegmationally operating heat exchanger elements 2.

Figure 5:
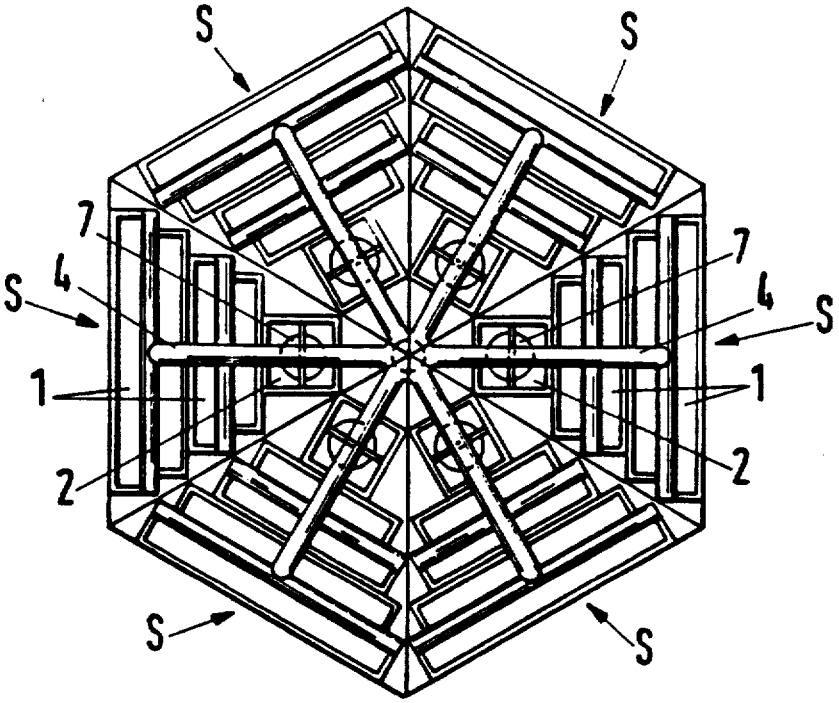
FIG. 5 is a further embodiment according to FIGS. 1, 3, and 4.

In the fourth example according to FIG. 5 an embodiment of the condensationally operating heat exchanger elements 1 is shown in which the radially outwardly extending portions of the pitched roof-type design according to the spacial possibilities are extended to the border line of the sector S. In this manner the free or unused space of the base surface area is reduced.

The present invention is, of course, in no way restricted to the specific disclosure of the specification and drawings, but also encompasses any modifications within the scope of the appended claims.

What we claim is:

1. A natural draft cooling tower for condensing turbine steam of a power plant, said cooling tower comprising:

individual identical sectors assembled to form said cooling tower;

a central steam inlet line terminating in radial distributing lines extending in a radial plane, each said sector having one said radial distributing line;

each said sector having first heat exchanger elements operating in a condensational manner and second heat exchanger elements operating in a dephlegmational manner, with said second heat exchanger elements arranged downstream of said first heat exchanger elements, said second heat exchanger elements each having at least one fan;

each said sector having an inert gas line connected to said second heat exchanger elements and a condensate removal line connected to said first and said second heat exchanger elements;

each said sector comprising an independent support frame for supporting said first and second heat exchanger elements, with said first heat exchanger elements connected to said support frame such that a longitudinal axis of each said first heat exchanger element is perpendicular to said radial distributing line and extends in a plane parallel to said radial plane of said radial distributing lines;

a cooling tower shell comprised of individual shell segments, wherein each said sector has one said shell segment, said cooling tower shell being a steel construction; and each said shell segment supported on said support frame of said sector.

2. A natural draft cooling tower according to claim 1, wherein said first and said second heat exchanger elements have the shape of a pitched roof.

3. A natural draft cooling tower according to claim 2, wherein each said first heat exchanger element has a radially outwardly extending portion and a radially inwardly extending portion with respect to a ridge of the pitched roof, with said radially outwardly extending portion having a greater longitudinal dimension than said radially inwardly extending portion.

4. A natural draft cooling tower according to claim 1, wherein said cooling tower shell has the shape of a closed polygon.

5. A natural draft cooling tower according to claim 1, wherein said second heat exchangers are arranged such that a longitudinal axis of each said second heat exchanger element is parallel to said longitudinal axis of said first heat exchanger elements.

6. A natural draft cooling tower according to claim 1, wherein said second heat exchangers are connected to said support frame directly adjacent to said central steam inlet line such that a longitudinal axis of each said second heat exchanger element extends radially.

7. A natural draft cooling tower according to claim 6, wherein said second heat exchangers have the shape of a pitched roof and comprise a suction chamber at the ridge of the pitched roof.

8. A natural draft cooling tower according to claim 1, wherein said first and said second heat exchanger elements within each said sector are arranged in a plane that is upwardly slanted in a radial outward direction from said central steam inlet line.

* * * * *